US006761285B2

(12) United States Patent
Bertone

(10) Patent No.: US 6,761,285 B2
(45) Date of Patent: Jul. 13, 2004

(54) AUTOMATED APPARATUS FOR DISPENSING A LIQUID WHITENER AND A LIQUID ADDITIVE IN A CUP OR THE LIKE

(76) Inventor: Claudio Bertone, 7510 Lisieux Street, St-Leonard, Quebec (CA), H1S 2G8

( * ) Notice: Subject to any disclaimer, the term of this patent is extended or adjusted under 35 U.S.C. 154(b) by 3 days.

(21) Appl. No.: 10/072,572

(22) Filed: Feb. 8, 2002

(65) Prior Publication Data

US 2002/0125268 A1 Sep. 12, 2002

Related U.S. Application Data

(60) Provisional application No. 60/267,638, filed on Feb. 9, 2001.

(51) Int. Cl.[7] ..... B65D 35/22

(52) U.S. Cl. ..... 222/94; 222/95; 222/144.5; 222/146.6; 222/504

(58) Field of Search ..... 222/94, 95, 105, 222/135, 144.5, 146.6, 185.1, 504

(56) References Cited

U.S. PATENT DOCUMENTS 4,027,783 A * 6/1977 Branch et al. ..... 222/26
4,753,370 A * 6/1988 Rudick ..... 222/105
5,366,117 A * 11/1994 Mesenbring et al. ..... 222/132
5,890,629 A * 4/1999 Loew ..... 222/144.5
5,938,078 A 8/1999 Dorsey et al. ..... 222/105
6,082,590 A 7/2000 Dorsey et al. ..... 222/146.6
6,095,372 A 8/2000 Dorsey et al. ..... 222/105
6,216,918 B1 * 4/2001 Saveliev et al. ..... 222/148

* cited by examiner

*Primary Examiner*—Joseph A. Kaufman
(74) *Attorney, Agent, or Firm*—RatnerPrestia

(57) ABSTRACT

An automated apparatus for dispensing a liquid whitener and a liquid additive in a cup or the like. The apparatus comprises a source of liquid whitener and a whitener tube having a whitener outlet and a source of liquid additive and an additive line having an additive outlet. The apparatus also comprises a whitener control connected to the whitener tube, an additive control connected to the additive line and a control board having at least one switch actuatable by a user for allowing the user to select a liquid whitener and a liquid additive. In operation, the whitener control allows dispersion of a predetermined amount of the selected liquid whitener through the whitener outlet, the additive control allows dispersion of a predetermined amount of the selected liquid additive through the additive outlet.

6 Claims, 8 Drawing Sheets

AUTOMATED APPARATUS FOR DISPENSING A LIQUID WHITENER AND A LIQUID ADDITIVE IN A CUP OR THE LIKE

CROSS-REFERENCE TO RELATED APPLICATIONS

This application claims the benefit of priority to U.S. Provisional Application Serial No. 60/267,638, titled "Multi-Flavored Hot Beverage Condiment Dispenser," filed on Feb. 9, 2001, and incorporated in this application by reference.

FIELD OF INVENTION

The present invention relates to an automated apparatus for dispensing a liquid whitener such as cream, half cream and half milk, whole milk, skim milk, 2% milk or creamer and a liquid additive such as liquid sugar, liquid French vanilla, liquid cinnamon, liquid hazelnut or liquid Irish cream. The liquid whitener and liquid additive are both dispensed in a single cup containing a potable beverage such as coffee, tea or hot chocolate.

BACKGROUND OF THE INVENTION

Heretofore, milk has been dispensed by utilizing small (½ ounce) plastic cups with a paper cover that is peeled off. This means of merchandising milk has many inherent problems, including, spoilage, waste, lost sales, higher operating costs, theft and low product variety. These portion packs are held in a plastic merchandiser that takes up approximately 8" or more of counter space.

In order to flavor and whiten coffee in today's market the customers only option is to use pre-flavored ½ ounce portion packs. These are pre-flavored within the portioned servings. The inherent problems remain spoilage, theft, waste and inflexibility. These portions packs are also held in a plastic merchandiser usually stacked above the milk portion packs.

It is also possible to dispense milk through a bulk milk dispenser having usually one or two plastic bulk bags of milk products in a refrigerated chamber. These types of units are designed for free flow type operation. Meaning that their customer would have to dislodge a lever in order to have the milk flow and then would have to re-engage the lever in order to stop the flow. Although these systems solved some of the problems like theft and spoilage they did not solve key flexibility and multi tasking problems that are addressed by the present invention. These machines are not capable of controlling a portion of milk, which is for example dispensing ½ ounce at a time. The other limiting factor is that most machines use one or two bags and therefore can dispense only one or two products. The operator does not have enough variety. If the operator wanted to dispense a flavored cream (French Vanilla, Hazelnut, Irish Cream etc) from one of these units the operator would have to remove one of the milk products. Therefore, in order to add more than two types of products the operator would have to add another machine as a result the operator has to use up additional counter space which is extremely valuable to the c-store and restaurant operator. The standard bulk cream machine is currently 14" wide, if the operator wants to add an additional option they must add an additional bulk whitener and utilize an additional 14 inches in counter space. In order to offer the same product variety as the 16" wide apparatus to be described, the current market options would require the utilization of 54" or more of counter space.

Sugar packets or Sweet & Low packets contain 15 grams of sweetener and are merchandised in plastic containers that can take up 8 to 10 inches of counter space. The inherent problems with this system are waste, messiness, theft and lost sales due to non-availability of the products due to the aforementioned reasons. A disadvantage is also the fact that these packets must be stored in containers that take up valuable counter space. In the food service/convenience store industry counter space utilization is instrumental in the success of a store. So much so that profits are calculated on a square inch basis. The sweetener section will occupy approximately 8 inches.

In order for the operator to offer his customer a flavored (French Vanilla, Irish Cream, Hazelnut etc.) coffee he would have to brew a complete batch of coffee produced from flavored ground coffee beans. As a result the operator would have to carry an extra stock of ground coffee. If he wants to offer four flavors in order to increase sales he would have to carry four extra stock in his store. The brewing of flavored coffee has also been curtailed in the past because of the fact that flavored coffees are only consumed during certain parts of the day. Also because of the fact that a complete batch had to be brewed and coffee flavor dissipated after 2 hours the operator has to throw away most of the batch.

The present invention provides an automated apparatus that requires less frequent refill servicing to support several choices of liquid whiteners and liquid additives than the traditional or current technologies.

SUMMARY OF THE INVENTION

The present invention seeks to provide an automated apparatus for dispensing a liquid whitener and a liquid additive in a cup or the like, said apparatus comprising: (a) a source of liquid whitener and a whitener tube, said source of liquid whitener being in fluid communication with said whitener tube, said whitener tube comprising a whitener outlet open to the atmosphere; (b) a source of liquid additive and an additive line, said source of liquid additive being in fluid communication with said additive line, said additive line comprising an additive outlet open to the atmosphere; (c) a whitener control connected to said whitener tube; (d) an additive control connected to said additive line; and (e) a control board having at least one switch actuatable by a user for allowing the user to select a liquid whitener and a liquid additive, said control board being connected to said whitener and additive controls, wherein, in operation, said whitener control allows dispersion of a predetermined amount of the selected liquid whitener through said whitener outlet, said additive control allows dispersion of a predetermined amount of the selected liquid additive through said additive outlet.

More preferably, the apparatus comprises a control board having a plurality of actuatable switches that are selectively actuated by a user and represent at least one of the following liquid whiteners: cream, half cream and half milk, whole milk, skim milk, 2% milk or creamer, the board also having a plurality of actuatable switches that are selectively actuated by a user and represent at least one of the following liquid additives: sugar, French vanilla, Irish cream, cinnamon and Hazelnut.

The whitener control comprises a solenoid having an actuator capable of engaging the whitener tube, the actuator being moveable from an open position wherein the whitener outlet is open, to a close position wherein the actuator engages the whitener tube for sealing the whitener outlet. Preferably, the movement of the actuator is regulated by a dampening means. In fact, the whitener control may comprise a proportional solenoid.

The apparatus may comprise a plurality of sources of liquid whitener, a plurality of whitener tubes, a plurality of sources of liquid additive, a plurality of additive lines, a plurality of whitener controls and a plurality of additive controls. Moreover, for each of the whitener tubes, a plurality of additive lines may be provided, the outlets of the plurality of additive lines being located around the whitener tube.

In order to maintain sanitary conditions, each of the sources of liquid whitener is in fluid communication with a separate whitener control that is in turn connected to a separate whitener tube. Likewise, each of the sources of liquid additive is in fluid communication with a separate additive control that is in turn connected to a separate additive line. The separate additive line may include a plurality of additive outlets however.

Other objects and features of the invention will become apparent by reference to the following description and the drawings.

BRIEF DESCRIPTION OF THE DRAWINGS

A detailed description of the preferred embodiments of the present invention is provided herein below, by way of example only, with reference to the accompanying drawings, in which.

DETAILED DESCRIPTION OF THE PREFERRED EMBODIMENT

Figure 1:
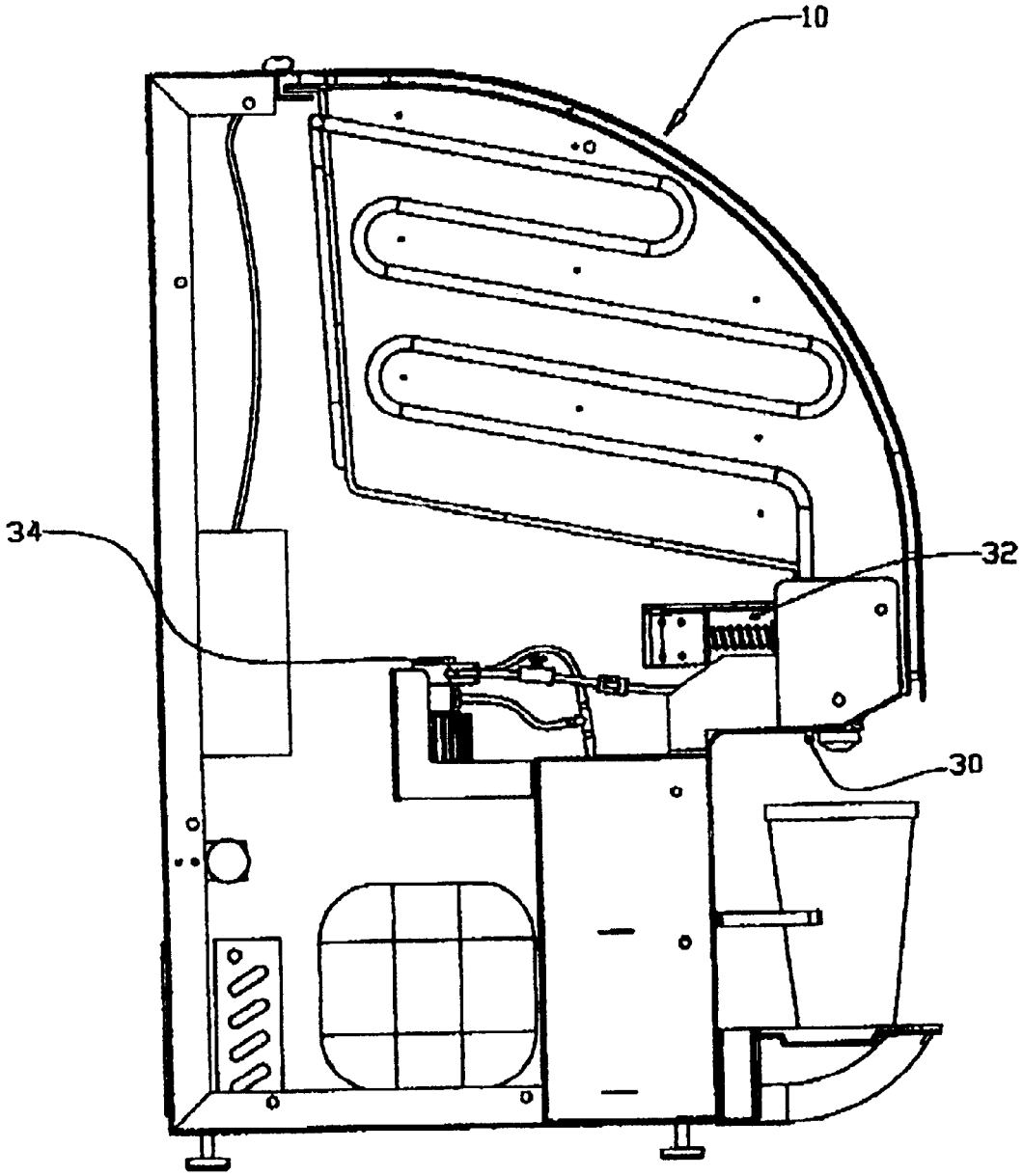
FIG. 1 is a partial cross-sectional view of an automated apparatus for dispensing a liquid whitener and a liquid additive in a cup or the like, constructed in accordance with an embodiment of the invention.

With reference to FIGS. 1 to 9, an automated apparatus for dispensing a liquid whitener and a liquid additive in a cup or the like, is generally depicted by reference numeral 10.

Figure 2:
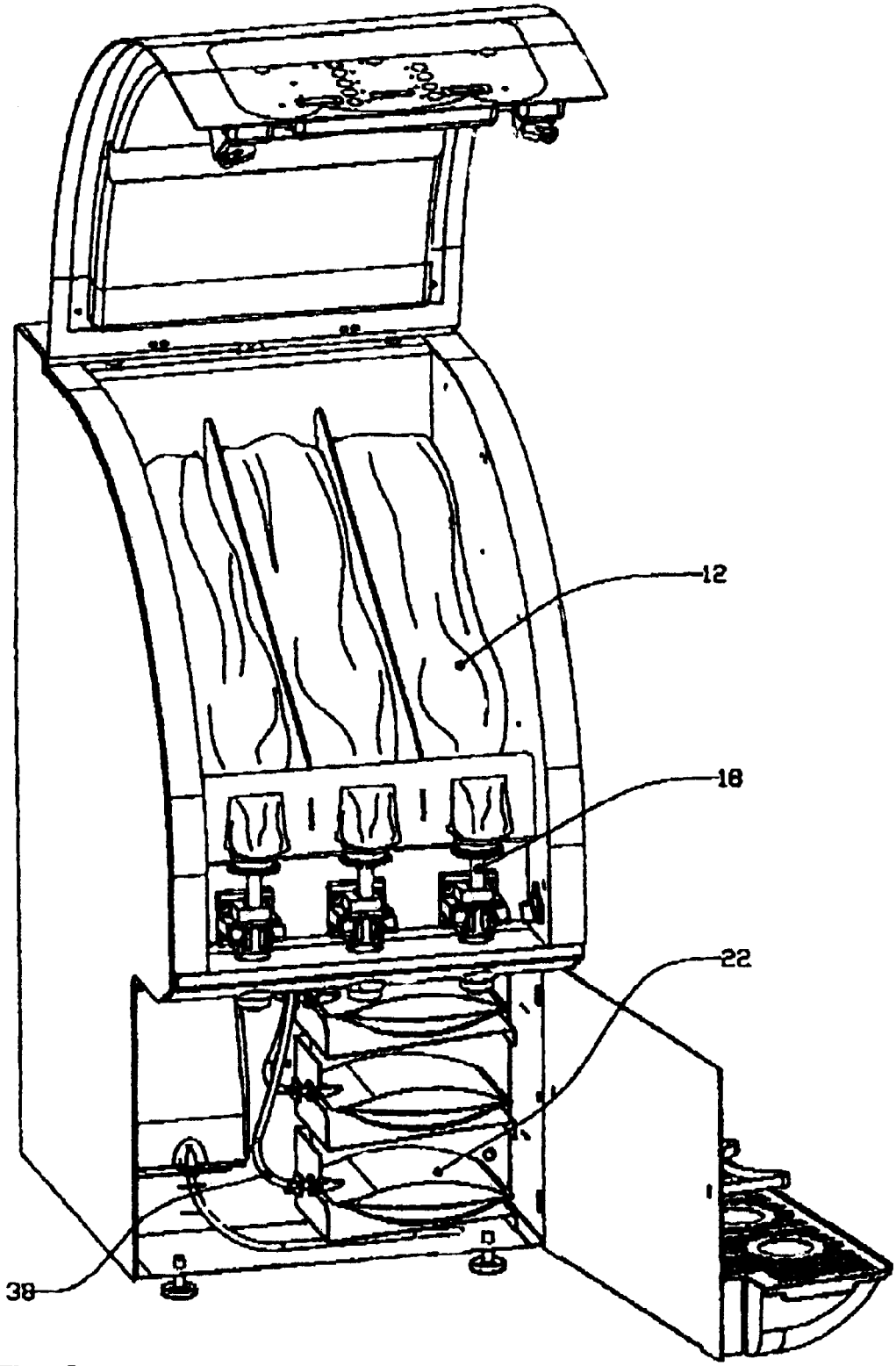
FIG. 2 is a perspective view of the apparatus illustrated in FIG. 1 with the front doors in an open position.
Figure 4:
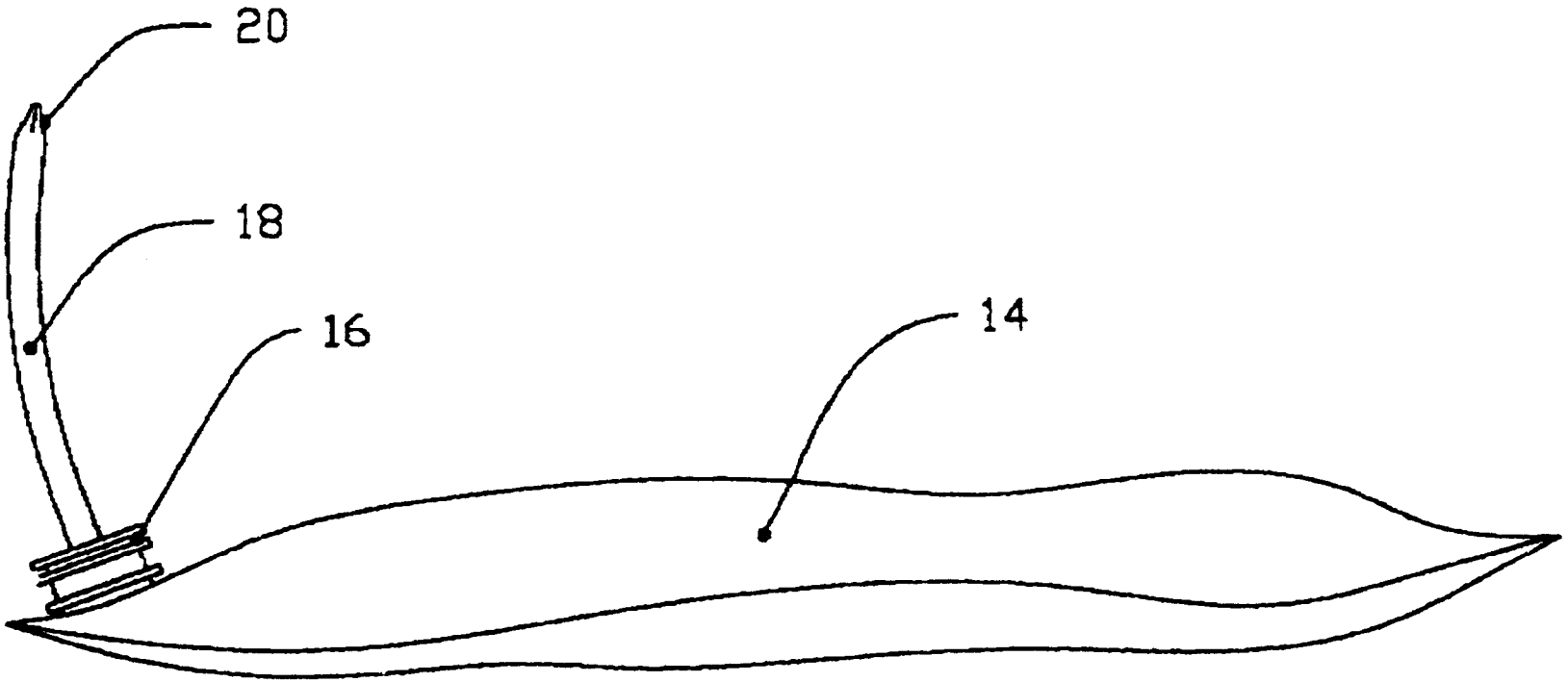
FIG. 4 is an enlarged side view of bag containing liquid whitener.

Referring to FIGS. 2 and 4, automated apparatus 10 comprises three compartments, each compartment being able to receive a source of liquid whitener 12 comprising a whitener bag 14 having a fitting 16. Source of liquid whitener 12 is in fluid communication with a whitener tube 18 having a whitener outlet 20 open to the atmosphere. Whitener outlet 20 is covered by a cover outlet 19 (see FIGS. 5–6). Typically, the liquid whitener can be selected from the group consisting of cream, half cream and half milk, whole milk, skim milk, 2% milk and creamer. It is understood that all potable liquid used for whitening a coffee, tea, hot chocolate or the like is encompassed by the terms "liquid whitener".

Figure 7:
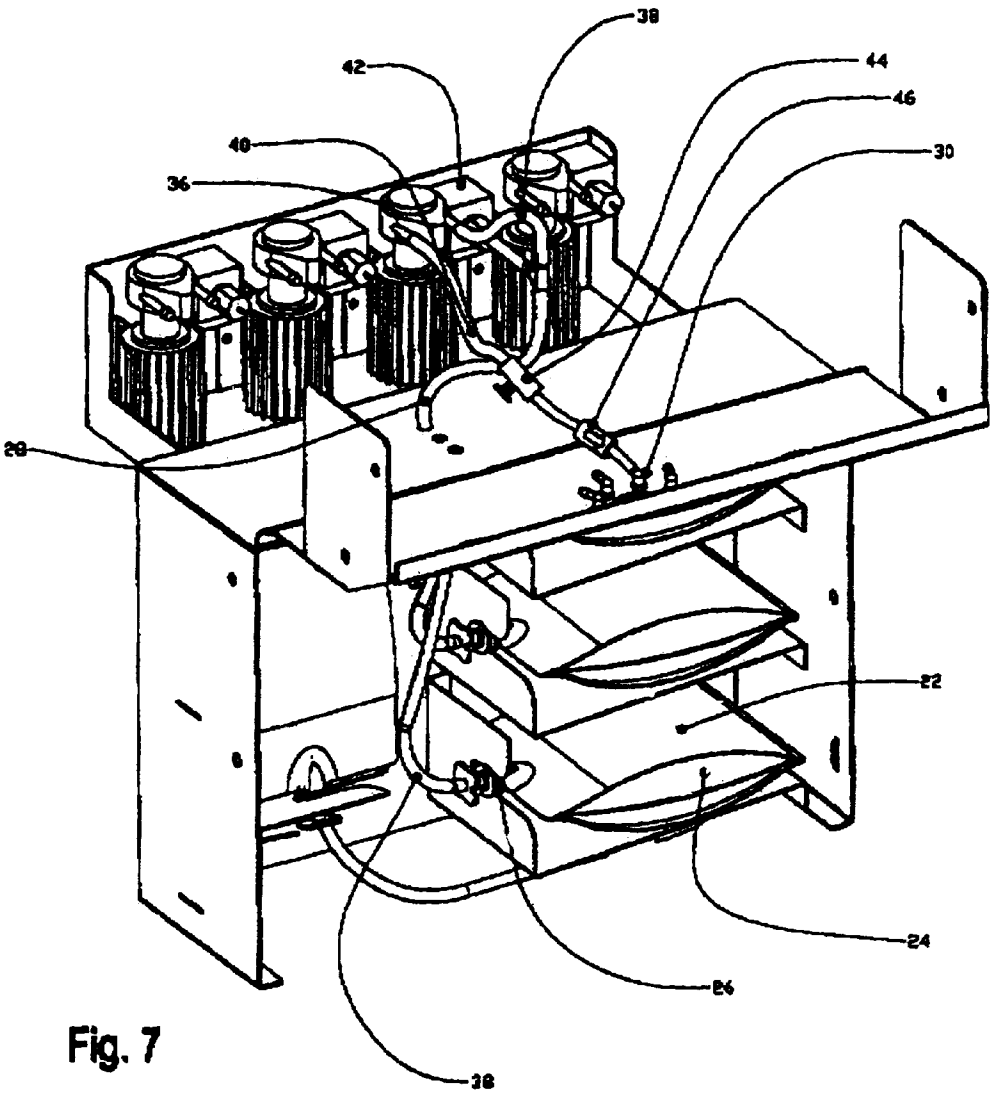
FIG. 7 is an enlarged perspective view showing a portion of the apparatus illustrated in FIG. 1.

Referring to FIGS. 2 and 7, automated apparatus 10 also comprises four shelves, each shelf being able to receive a source of liquid additive 22 comprising an additive bag 24 and a fitting 26. Source of liquid additive 22 is in fluid communication with an additive line 28. Typically, the liquid additive can be selected from the group consisting of liquid sugar, liquid French vanilla, liquid Irish cream, liquid cinnamon and liquid Hazelnut. It is understood that all potable liquid used for flavoring or sweetening a coffee, tea, hot chocolate or the like is encompassed by the terms "liquid additive". Additive line 28 comprises an additive outlet 30 open to the atmosphere. It is understood that additive outlet 30 is located near whitener outlet 20 in order to allow dispersion of the liquid whitener and the liquid additive in a single cup.

Automated apparatus 10 does not require frequent sanitary inspections or cleaning processes since whitener bag 14 or additive bag 24 is simply removed and replaced with another bag when empty.

Automated apparatus 10 further comprising a whitener control 32 connected to whitener tube 18 and an additive control 34 connected to additive line 28.

Figure 8:
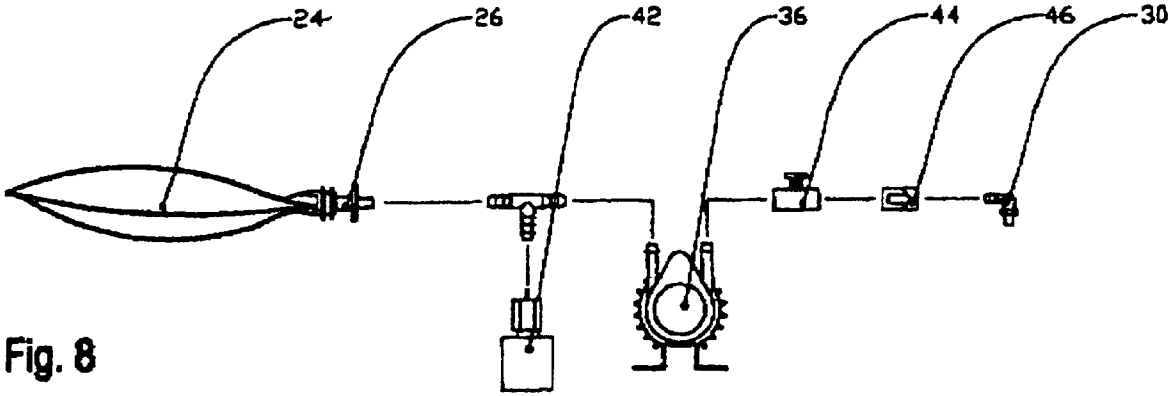
FIG. 8 is a schematic view of an additive line constructed in accordance with a first variant.
Figure 9:
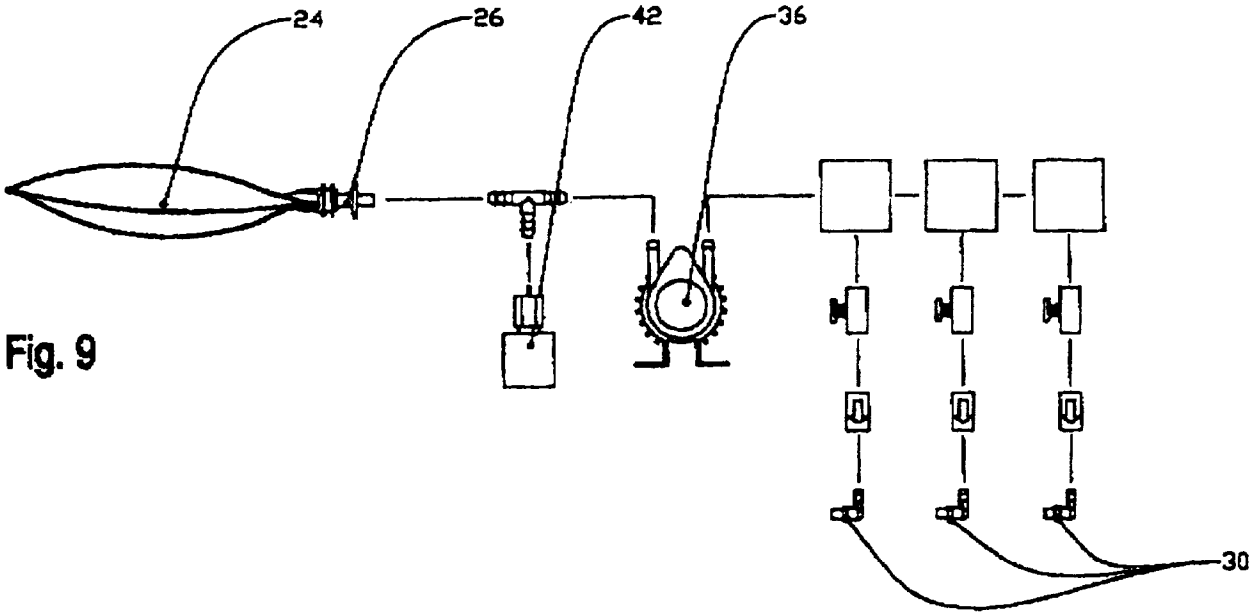
FIG. 9 is a schematic view of an additive line constructed in accordance with a second variant.

Referring to FIGS. 7 to 9, additive control 34 comprises a pump 36 in fluid communication with source of liquid additive 22 and with additive outlet 30 respectively. Additive line 28 also comprises a first tube 38 connecting source of liquid additive 22 with pump 36 and a second tube 40 connecting pump 36 and additive outlet 30. A vacuum switch 42 is mounted on first tube 38 for stopping operation of pump 36 when additive bag 24 is empty. An adjustable valve 44 and a check valve 46 are mounted on second tube 40. Adjustable valve 44 allows adjustment of the flow of the liquid additive in additive line 28.

Figure 5:
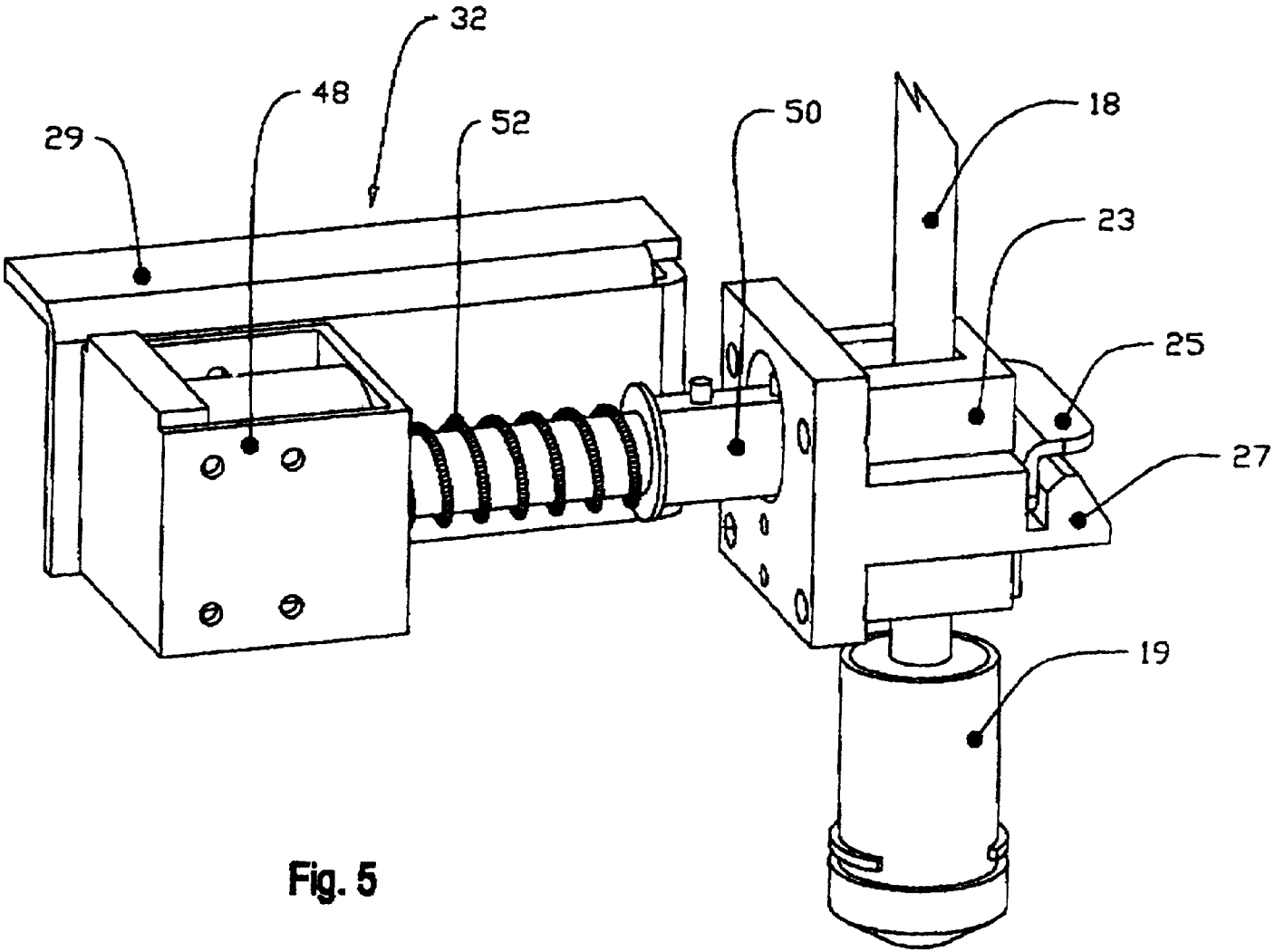
FIG. 5 is an enlarged side view of a whitener control.
Figure 6:
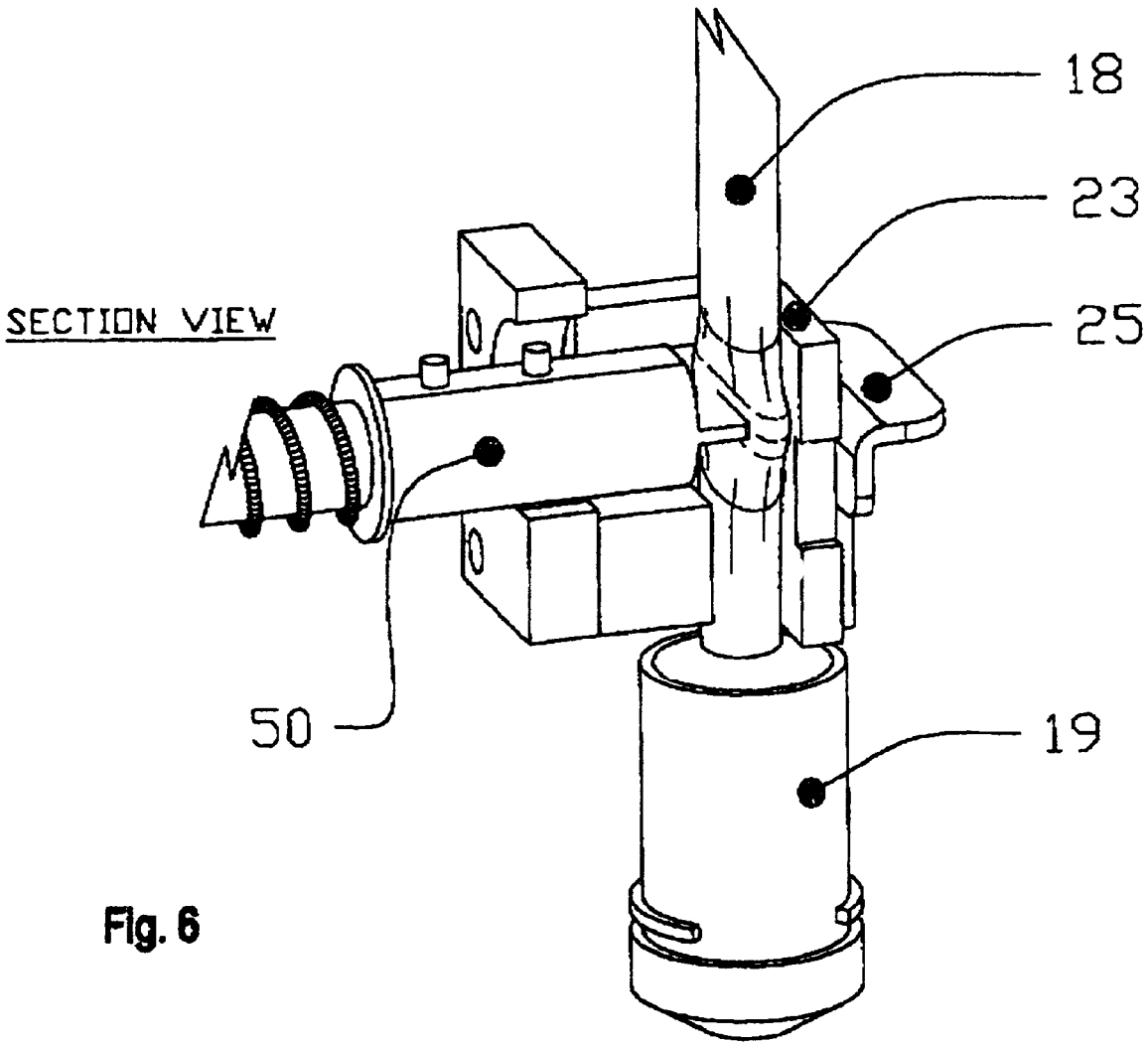
FIG. 6 is a partial view of the whitener control of FIG. 5 illustrated in a close position.

Referring to FIGS. 5 and 6, whitener control 32 comprises a solenoid 48 having an actuator 50 capable of engaging whitener tube 18, actuator 50 being moveable between an open position wherein whitener outlet 20 is open, to a close position wherein actuator 50 engages whitener tube 18 for sealing whitener outlet 20 (see FIG. 6). Preferably, the movement of the actuator is regulated by a dampening means. In fact, whitener control 32 may comprise a proportional solenoid. Whitener control 32 further comprises a biasing means such as a spring 52 for urging actuator 50 against whitener tube 18 for sealing whitener outlet 20 when solenoid 48 is not activated.

Whitener control 32 also comprises a piston backstop 23 that is used as a back stop when squeezing whitener tube 18. This component is designed in order to easily be removes from whitener control 32 in order to facilitate pouch loading and tube insertion. Piston backstop 23 is supported by and slid onto supporting arms 27, piston backstop 23 is locked into place by sliding a gate 25 down into place and locking it in. In order to remove piston backstop 23, gate 25 is raised and piston backstop 23 is slid out of supporting arms 27. Solenoid 48 is supported and mounted to a support bracket 29.

Figure 3:
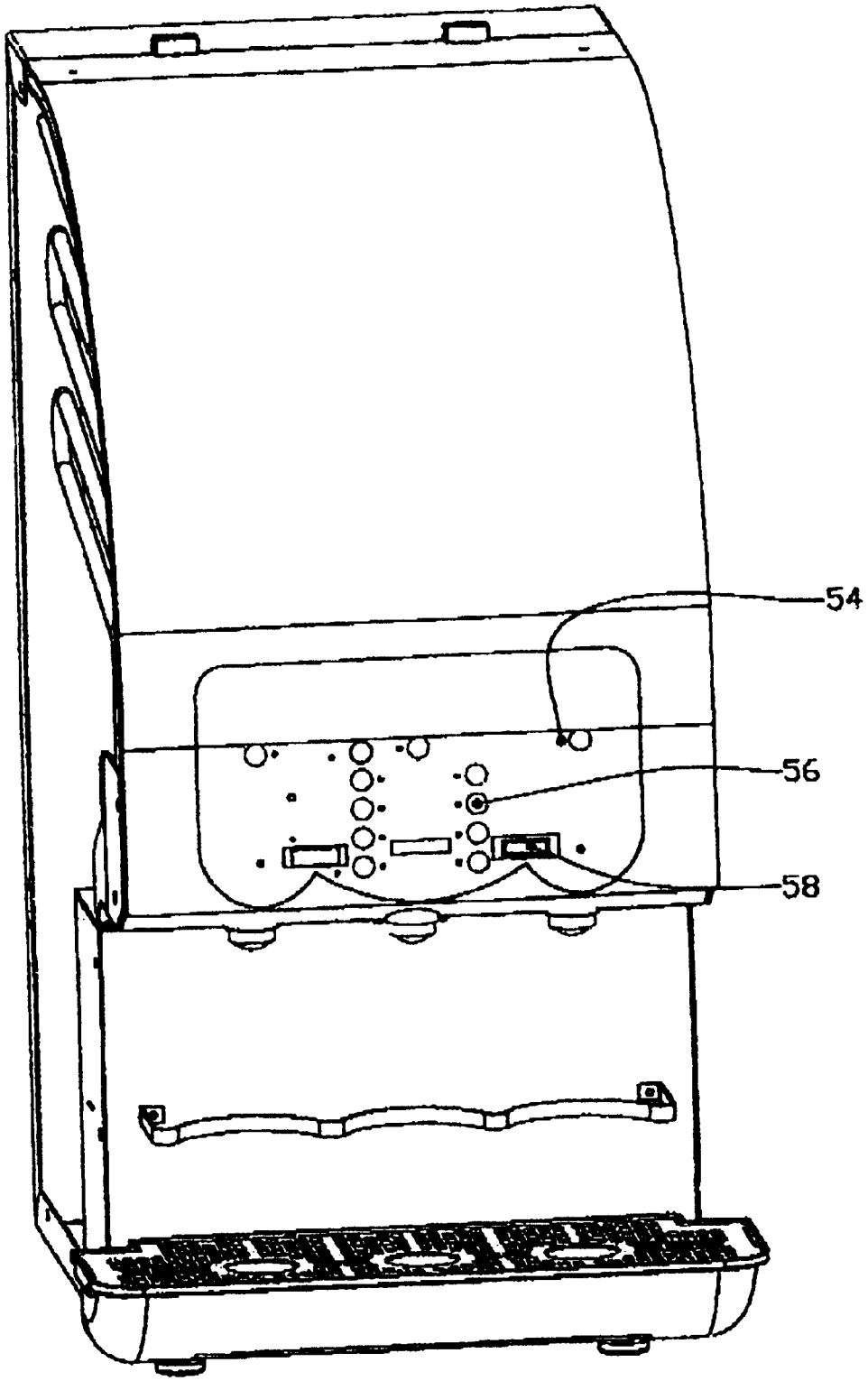
FIG. 3 is a perspective view of the apparatus illustrated in FIG. 1 with the front doors in a close position.

Referring to FIG. 3, automated apparatus 10 also comprises a control board 54 having at least one switch 56 actuatable by the user to select a liquid whitener and a liquid additive. For example, control board 54 may comprise a plurality of actuatable switches that are selectively actuated by the user and represent at least one of the following liquid whiteners: cream, half cream and half milk, whole milk, skim milk and 2% milk. Control board 54 may also comprises a plurality of actuatable switches that are selectively actuated by a user and represent at least one of the following liquid additives: liquid sugar, liquid French vanilla, liquid Irish cream, liquid cinnamon and liquid Hazelnut.

It is understood that automated apparatus 10 may comprise a plurality of sources of liquid whitener 12, a plurality of whitener tubes 18, a plurality of sources of liquid additive 22, a plurality of additive lines 28, a plurality of whitener controls 32 and a plurality of additive controls 34. Moreover, for each of whitener tubes 18, a plurality of additive lines 28 may be provided, outlets 30 being located around outlet 20.

In operation, the user depresses the appropriate switch (es) for selecting the liquid whitener and the liquid additive of his choice. Upon depression of the appropriate switch (es), a signal is transmitted to whitener control 32 and additive control 34. Whitener control 32 then activates solenoid 48 that in turn moves actuator 50 toward the open position and back to the close position, the time and distance of movement of actuator 50 being calibrated in order to allow dispersion of a predetermined amount of the selected liquid whitener through diary outlet 20. Likewise, additive control 34 then activates pump 36 for a specific amount of time in order to allow dispersion of a predetermined amount of the selected liquid additive through additive outlet 30.

Each of sources of liquid additive 22 is in fluid communication with separate additive control 34 that is in turn connected to separate additive line 28. Separate additive line 28 may include additive outlet 30 as shown in FIG. 7 or a plurality of additive outlets 30 as shown in FIG. 8. In the variant illustrated in FIG. 8, the additive line includes Y fittings and solenoids for allowing passage of the liquid additive through the appropriate additive outlet 30.

Control board 54 can include a display 58 to provide information to the user, for example any messages that control board 54 is programmed to display such as the selected liquid whitener, the selected liquid additive, the price etc. Control board 54 can also include a keypad for programming different parameters such as values of the predetermined amount of the liquid whitener dispersed, values of the predetermined amount of the liquid additive dispersed, interior temperature etc.

Automated apparatus 10 also comprises a refrigeration system for maintaining the liquid whitener at a temperature between 30 and 45 degrees F., more preferably between 35 and 40 degrees F. The refrigeration system comprises an evaporator coil, a compressor, a condenser, a fan and a temperature control.

The above description of the preferred embodiment should not be interpreted in any limiting manner since variations and refinements are possible which are within the spirit and scope of the present invention. The scope of the invention is defined in the appended claims and their equivalents.

What is claimed is:

1. An automated apparatus for dispensing a liquid whitener and a liquid additive in a cup, said apparatus comprising:

(a) a source of liquid whitener and a whitener tube, said source of liquid whitener being in fluid communication with said whitener tube, said whitener tube comprising a whitener outlet open to the atmosphere;

(b) a source of liquid additive and an additive line, said source of liquid additive being in fluid communication with said additive line, said additive line comprising an additive outlet open to the atmosphere;

(c) a whitener control connected to said whitener tube; said whitener control comprising a solenoid having an actuator capable of engaging said whitener tube, said actuator being moveable from an open position wherein said whitener outlet is open, to a close position wherein said actuator engages said whitener tube for sealing, said whitener control further comprising a biasing means urging said actuator against said whitener tube for sealing said whitener outlet when said solenoid is not activated;

(d) an additive control connected to said additive line, said additive control comprising a pump in fluid communication with said source of liquid additive and with said additive outlet;

(e) a control board having at least one switch actuatable by a user for allowing the user to select a liquid whitener and a liquid additive, said control board being connected to said whitener and additive controls, wherein, in operation, said whitener control allows dispersion of a predetermined amount of the selected liquid whitener through said whitener outlet and said additive control allows dispersion of a predetermined amount of the selected liquid additive through said additive outlet; and (f) wherein said additive line comprises (i) a first tube connecting said source of liquid additive to said pump, said first tube having a vacuum switch mounted thereon; and (ii) a second tube connecting said pump to said additive outlet, said second tube having an adjustable valve and a check valve mounted thereon.

2. The apparatus of claim 1 further comprising a refrigeration system having a compressor, a condenser, an evaporator and a fan for maintaining the liquid whitener at a temperature between 30 and 45 degrees Fahrenheit.

3. The apparatus of claim 2 wherein said control board comprises a plurality of actuatable switches that are selectively actuated by the user and that represent one of the following liquid whiteners: cream, half cream and half milk, whole milk, skim milk, 2% milk and creamer.

4. The apparatus of claim 3 wherein said control board comprises a plurality of actuatable switches that are selectively actuated by the user and that represent one of the following liquid additives: sugar, French vanilla, Irish cream, cinnamon and Hazelnut.

5. The apparatus of claim 4 wherein:

(a) said source of liquid additive is a first source of liquid additive, said apparatus further comprising a second source of liquid additive;

(b) said additive line is a first additive line, said apparatus further comprising a second additive line, said first and second sources of liquid additive being in fluid communication with said first and second additive lines respectively, said first and second additive lines comprising respective first and second additive outlets being located around said whitener outlet; and (C) said additive control is a first additive control, said apparatus further comprising a second additive control, said first and second additive controls being connected to said first and second additive lines respectively, and, in operation, one of said first and second additive controls allows dispersion of a predetermined amount of the selected liquid additive through one of said first and second additive outlets.

6. The apparatus of claim 4 wherein:

(a) said source of liquid whitener is a first source of liquid whitener, said apparatus further comprising a second source of liquid whitener;

(b) said whitener tube is a first whitener tube, said apparatus further comprising a second whitener tube, said first and second sources of liquid whitener being in fluid communication with said first and second whitener tubes, said first and second whitener tubes comprising respective first and second outlets;

(c) said source of liquid additive is a first source of liquid additive, said apparatus further comprising a second source of liquid additive;

(d) said additive line is a first additive line, said apparatus further comprising a second additive line, said first and second sources of liquid additive being in fluid communication with said first and second additive lines respectively, said first and second additive lines comprising respective first and second additive outlets being located around one of said first and second whitener outlets;

(e) said whitener control is a first whitener control, said apparatus further comprising a second whitener control, said first and second whitener controls being connected to said first and second whitener tubes respectively;

(f) said additive control is a first additive control, said apparatus further comprising a second additive control, said first and second additive controls being connected to said first and second additive lines respectively, and, in operation, one of said first and second whitener controls allows dispersion of a predetermined amount of the selected liquid whitener through one of said first and second whitener outlets, and one of said first and second additive controls allows dispersion of a predetermined amount of the selected liquid additive through one of said first and second additive outlets.

* * * * *